US005094132A

United States Patent [19]

Engel

[11] Patent Number: 5,094,132

[45] Date of Patent: Mar. 10, 1992

[54] ADJUSTABLE HAND WRENCH

[76] Inventor: Douglas A. Engel, 2935 W. Chenango, Englewood, Colo. 80110

[21] Appl. No.: 597,563

[22] Filed: Oct. 15, 1990

[51] Int. Cl.[5] ..... B25B 7/12

[52] U.S. Cl. ..... 81/363; 81/356; 81/373

[58] Field of Search ..... 81/352-356, 81/361-363, 367-377

[56] References Cited

U.S. PATENT DOCUMENTS 3,608,405 9/1971 Schmidt ..... 81/356
4,144,738 3/1979 Dziura et al. ..... 81/363 X
4,797,965 1/1989 Mazzone ..... 81/356 X

*Primary Examiner*—D. S. Meislin
*Attorney, Agent, or Firm*—William E. Hein

[57] ABSTRACT

A tool is comprised of a combination of a vice grip brand adjustable clamping pliers and a parallel jaw adjustable wrench such that the parallel jaws have been mounted on the end of the adjustable clamping pliers and the handle of the parallel jaw adjustable wrench has been discarded and the jaws of the clamping pliers has been discarded resulting in a new and novel tool with some capabilities of both tools and in addition many new uses.

2 Claims, 1 Drawing Sheet

FIG.4
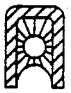
FIG.3
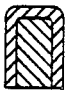
FIG.5
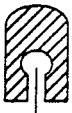
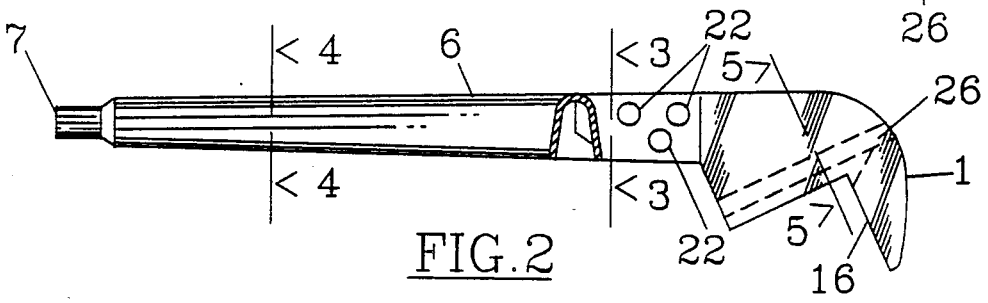
FIG.2
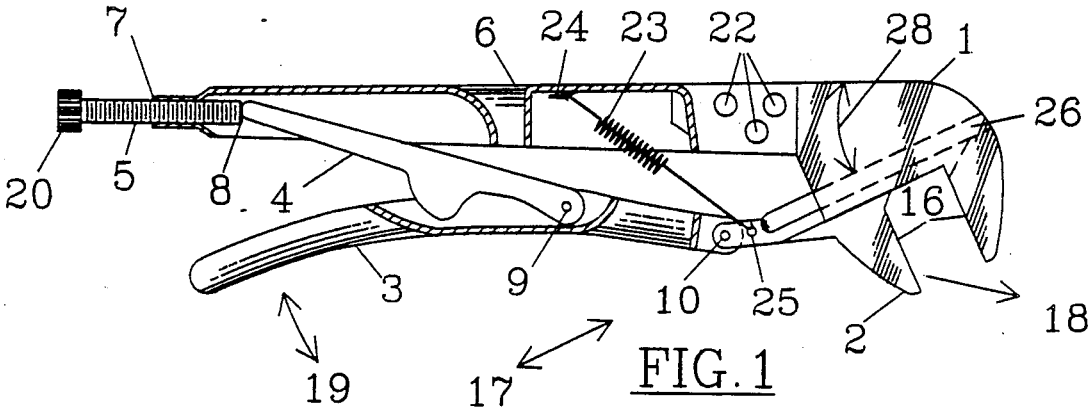
FIG.1
FIG.9
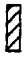
FIG.11
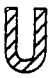
FIG.7
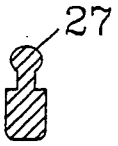
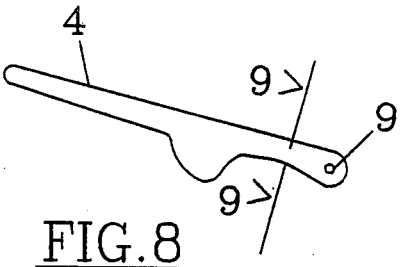
FIG.8
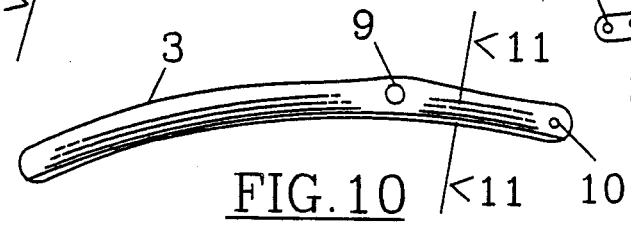
FIG.10
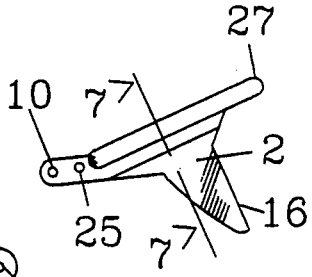
FIG.6

ADJUSTABLE HAND WRENCH

BACKGROUND OF THE INVENTION

1. Field of the invention

The present invention relates generally to hand tools of the clamping or locking type. There are many different tools used for locking tightly on bolts and other objects. Most notable among these are the vise grip brand tools presently made and marketed by many different companies around the world. The great objection to most of these tool is that they tend to bite and tear up good bolts and nuts, etc. The crescent wrench brand wrenches have parallel adjustable jaws. The objection here is that the jaws are difficult to adjust correctly and constantly need readjusting as they tend to loosen quickly and they have no handy clamping action. other parallel jaw locking pliers are not very stable and tend to be easily broken and over stressed. Specifically the present invention relates to a device that incorporates the vise grip action of the vise grip brand type tool along with the parallel jaw action of the crescent wrench brand type of tool.

2. Brief description of the prior art

Prior inventions relate to vise clamps that have a parallel action such as a bench vise and furniture clamps all of which use a common helical screw to effect the parallel tightening action on the clamped object A parallel jaw plier made by the BMC Manufacturing Corporation of Binghamton, New York uses a circular cam principle to effect the parallel adjustment. These pliers are not very sturdy and the jaws tend to become non parallel and are easily over stressed.

OBJECTS AND SUMMARY OF THE INVENTION

It is the specific object of the present invention to provide a device that gives the excellent parallel action of the crescent brand wrench along with the tremendous clamping force of the vice grip brand pliers. This invention realizes a beautiful and harmonious marriage of the vise grip and crescent brand wrenches to create a simple adjustable parallel locking jaw wrench with vise like power and a multitude of uses. By removing the adjusting screw of the crescent wrench and taking the end jaws off the vise grip and retaining only the main handle, adjusting screw and locking levers of the vice grip then welding or riveting the large head or outer jaw of the crescent tool to the large handle of the vise grip tool and rotateably pinning the clamping lever of the vise grip tool to the adjustable part of the crescent wrench in such a way that the locking action creates a force vector aimed from the adjusting screw fulcrum to the center of the adjustable parallel jaw a wonderful new tool has been created. It can be called the parallel jaw vice wrench or, simply, the vicewrench.

BRIEF DESCRIPTION OF THE DRAWINGS

FIG. 1 is a view of the tool showing sectioned cut away areas in order to reveal inner parts of the device.

FIG. 2 is a view of the main wrench handle and the riveted outer jaw.

FIG. 3 is a section of the main handle where it wraps around a portion of the outer parallel jaw.

FIG. 4 is a section of the main handle

FIG. 5 is a section of the outer jaw showing the slide groove made to accept the sliding inner jaw.

FIG. 6 is a view if the inner sliding jaw.

FIG. 7 is a section of the sliding inner jaw showing the slide bar made to reside slidably in the outer jaw slide groove.

FIG. 8 is a view of the fulcrum lever made to pin to the handle lever and press against the adjusting screw.

FIG. 9 is a section of the fulcrum lever.

FIG. 10 is view if the clamping and releasing lever made to pin hingedly to the fulcrum lever and the inner sliding jaw.

FIG. 11 is a section of the clamping and releasing lever.

DESCRIPTION OF THE PREFERRED EMBODIMENTS

The basic structural elements of the invention are a main handle, an adjusting screw, an outer jaw, an inner sliding jaw, and a pair of levers. FIG. 1 shows the main handle element 6 with the adjustable screw 5 with knurled end 20 and levers 3 and 4 and inner jaw 2 and outer jaw 1. The adjusting screw 5 presses against lever 4 at fulcrum point 8. The clamping lever 3 is pinned to the fulcrum lever 4 at the point 9 where the pin axis is perpendicular to the plane of the drawing or parallel to the turning axis of a bolt or nut to which the tool is clamped in the most usual manner. This release and clamping lever 3 moves in the directions shown by the arrows 19. The sliding jaw 2 is pinned to the clamping lever at 10 perpendicularly to the plane of the drawing and the main axis of the wrench. The inner jaw 2 slides in the direction of the arrows 17. When the clamping lever is released the retracting spring 23 aids in withdrawing the inner jaw 2. The outer jaw 1 is shown in FIG. 1 riveted to the main handle 6 at points 22. The inner and outer jaw possess parallel clamping surfaces 16 made to clamp tightly on an object such as a bolt or nut. When the device is fully clamped as shown in FIG. 1 the lever 4 should be aimed along its long axis approximately within the jaw areas 16 to produce the force vector 18 approximately as shown. The angle 28 should not be too great as this would cause the sliding jaw 2 to bind against the slide groove 26 in the outer jaw. A round slide bar 27 attached to the inner jaw 2 is slidably retained to slide linearly in the accepting groove 26 in the outer jaw 1. A retracting spring 23 is hooked to the main handle at hook 24 and to inner jaw 2 at a hole 25 shown in FIG. 6. Although this invention has been described according to a preferred embodiment it will be appreciated that many variations and modifications and applications of the invention may be constructed. The tool could be in the form of a hand vise made for holding objects to be worked on, or the jaws could be modified to allow punching of holes in sheet material of various sorts, or the jaws could be modified with a matching negative and positive relief design allowing the device to be used to stamp a brand, symbol, profile, or other indicia in various materials. It should also be appreciated that while both the vice grip brand of clamping pliers and the adjustable parallel jaw wrench are both very well known and very popular tools their combination is a new and novel device of a highly useful nature having some of the capabilities of both tools and additionally the ability to lock securely onto bolts and other materials without appreciably damaging them.

What is claimed is:

1. An adjustable hand wrench comprising:

a main handle adapted for being gripped by the user, the main handle having an adjusting screw at a rearward end thereof and a fixed outer jaw at a forward end thereof, the outer jaw having an inner surface for engaging an object and a linear groove perpendicular to said inner surface;

an inner jaw having an inner surface that faces the inner surface of the outer jaw and that is parallel therewith, the inner jaw including a linear slide bar mating with said linear groove and being arranged for linear motion, within said linear groove of said outer jaw, toward and away from the outer jaw while at the same time maintaining the inner surface of the inner jaw parallel to the inner surface of the outer jaw, thereby permitting engagement and disengagement of the object between the inner surfaces of the inner and outer jaws;

a clamping lever having a rearward portion adapted for being gripped by the user and a forward end pivotally connected directly to the inner jaw at a pivot point located at an extremity of said inner jaw rearward of its inner surface, said pivot point being in direct alignment with a longitudinal axis of and rearward of said slide bar; and a fulcrum lever having a rearward end retained by said adjusting screw and a forward end pivotally connected to said clamping lever at a point rearward of the pivotal connection thereof to said inner jaw;

the clamping lever being operative, when moved away from the main handle, for causing linear motion of the inner jaw away from the fixed jaw, and being further operative, when moved toward the main handle, for causing linear motion of the inner jaw toward the fixed jaw to a separation distance that is predetermined in accordance with a setting of the adjusting screw.

2. An adjustable hand wrench as in claim 1 wherein the inner surface of each of the inner and outer jaws is smooth.

* * * * *